United States Patent [19]

Chamdru

[11] 3,987,842

[45] Oct. 26, 1976

[54] PLASTIC CORE BLOW NOZZLE WITH FASTENING HOOKS

[75] Inventor: Jacques André Chamdru, Boulogne-Billancourt, France

[73] Assignees: Regie Nationale des Usines Renault; Automobiles Peugeot, both of France

[22] Filed: July 21, 1975

[21] Appl. No.: 597,333

[30] Foreign Application Priority Data

Aug. 2, 1974 France ..... 74.27000

[52] U.S. Cl. ..... 164/200; 164/412

[51] Int. Cl.[2] ..... B22C 15/24

[58] Field of Search ..... 164/200, 201, 202, 412

[56] References Cited

UNITED STATES PATENTS

| | | | |
|---|---|---|---|
| 3,163,894 | 1/1965 | Bego et al. | 164/202 |
| 3,235,921 | 2/1966 | Bego et al. | 164/200 |
| 3,903,952 | 9/1975 | Bego et al. | 164/200 |

*Primary Examiner*—Robert D. Baldwin

*Attorney, Agent, or Firm*—Stevens, Davis, Miller & Mosher

[57] ABSTRACT

A nozzle for blowing foundry cores, the nozzle being adapted to be fitted to a filling tray of a type operated in conjunction with the hot-box process. The nozzle consists of a pair of tubular concentric plastic sleeves assembled and shaped to provide an intermediate annular-sectioned space constituting a cooling jacket in which water is circulated, the male sleeve carrying at its lower end a plastic nose-piece adapted to withstand heavy abrasive and thermal conditions.

3 Claims, 12 Drawing Figures

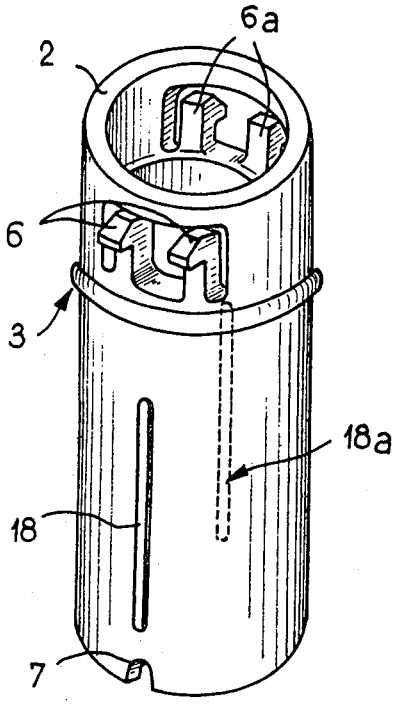
Fig-1
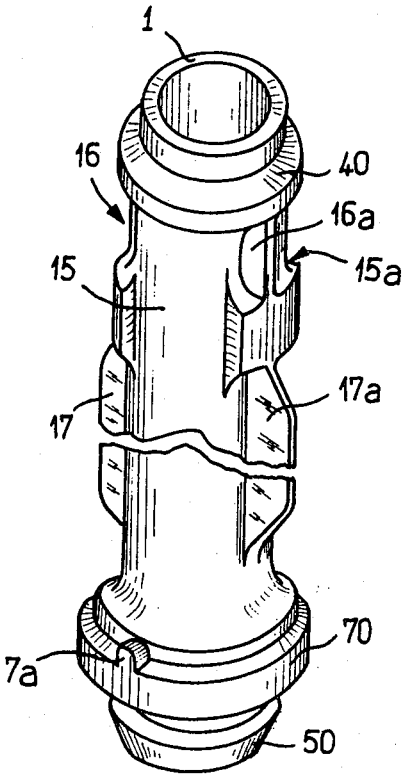

Fig-6
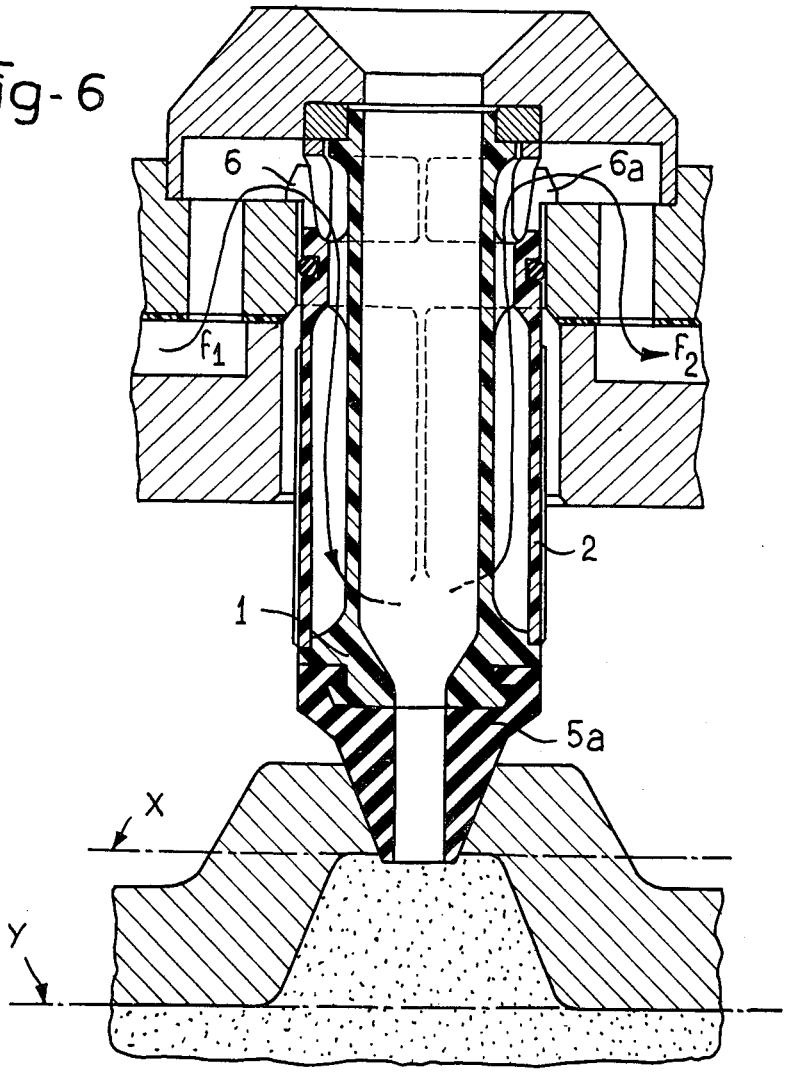
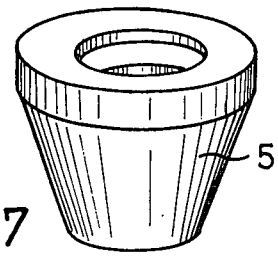
Fig-7
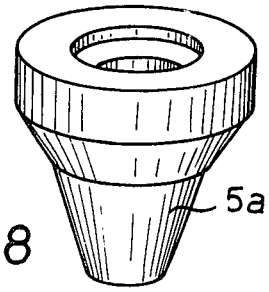
Fig-8

PLASTIC CORE BLOW NOZZLE WITH FASTENING HOOKS

The present invention relates to blow nozzles of the type currently used in foundry shops or smelting plants for making sand moulds and cores by blowing sand into a foundry device usually referred to as a "hot box".

At present for obtaining sanded cores by the so-called hot-box process two main methods are employed. The first method consists of filling by using sand cones. These sand cones remain on the core after the removal thereof, so that the cones must be broken, as a rule, for fitting the cores when remoulding into the moulding frame. The second method consists of filling by means of metal nozzles or jets having a plastic nose-piece, for instance of a fluorinated elastomer composition. These nozzles incorporate a cooling circuit to prevent the sand from being cured.

The use of such nozzles or jets is therefore attended by the difficult problem of releasing thermal stresses developing therein during their operation. In fact, the area of each nozzle that contacts the filling tray to which it is secured is cooled by the cooling circuit of said tray, while the other area engaging the box is exposed to temperatures of the order of 180° to 230° C. On the other hand the nozzles must be shaped with a view to make up or compensate the expansion effect of the hot box.

Moreover, upon each operation these nozzles are subjected not only to vertical upward stresses, which are however controlled, but also to horizontal efforts in all directions, which are the most detrimental since they imply a substantial reduction in the useful life of the plastic nose-piece. It may also be emphasized that all ills are not chargeable to expansion alone, since other factors tend to increase these horizontal efforts in all kinds of moulding machines, such as tool transfer machines, rotary-station machines, or tool-reversing machines, the most detrimental effort resulting from the snap-action resetting of the tool means at the filling station.

However, one fraction of the expansion could be compensated for from the onset when making the tools by taking due account of the coefficient to thermal expansion and providing nozzles secured to the filling tray and so disposed that their distances between centers is greater than the distance between centers of the box before heating the same.

It is known that, for obvious reasons, tool manufacturers oppose this method since they are thus unable to check the proper fitting between the filling tray and the box before delivering the tools to the actual users.

Hitherto known filling trays comprise as a rule two plates, one plate incorporating the cooling circuit and the other the sand passages or ducts. But due to the fitting of blow nozzles with accurate tolerances for the distances between centers and because the bores to be formed through these two plates for mounting the nozzle bodies are provided with O-ring type seals, it is obvious that these plates are extremely expensive to manufacture.

It is the primary object of the present invention to provide foundry core blow nozzles capable of avoiding the above-mentioned inconveniences, these improved nozzles being adapted not only to be manufactured at a relatively low cost, due notably to the small number of parts constituting each nozzle, but also to be easilly secured to the filling tray, this last-mentioned feature further facilitating the manufacture of said filling tray.

The nozzle according to the present invention comprises a pair of tubular sleeves of suitable plastic material, which form a male member and a female member, respectively, assembled concentrically and shaped to provide therebetween an intermediate annular space constituting a cooling jacket for the water cooling system, the male sleeve carrying at its lower end a plastic end-piece or nose-piece capable of withstanding heavy abrasive and thermal conditions.

The filling tray comprises a pair of superposed plates assembled to each other and, for sealing the cooling circuit against leakages, a thin gasket disposed therebetween, one plate comprising a cooling circulation system consisting of a groove slihtly wider than the distance between centers of the fitted nozzles and of a length varying as a function of the circuit configuration designed to obtain the maximum cooling efficiency.

The blow nozzle according to this invention may advantageously be manufactured by injection moulding, the same tool means being adapted to produce nozzles of different diameters by simply changing the axial spindle, and therefore may be manufactured at a relatively low cost.

This invention also comprises the nozzle assemblies according to the present invention, mounted on filling trays provided with a pressure cooling circuit used by each nozzle as a means for dissipating heat, when the nozzles engage the hot box.

In order to afford a clearer understanding of this invention and of the manner in which the same may be carried out in actual practice, a detailed description of the blow nozzles constituting the present invention will now be described by way of illustration, not of limitation, with reference to the attached drawings, in which:

FIG. 1 is an elevational view of a blow nozzle according to this invention, prior to its assembly and without its nose- or end-piece;

FIG. 6 is an axial longitudinal section showing another method of mounting the nozzle to the filling tray, the nozzle leading to a plane X above said plane Y;

FIG. 7 is a perspective view showing a typical form of embodiment of the nose- or end-piece for the blow nozzles of this invention;

FIG. 8 is a perspective view of another form of embodiment of the nose- or end-piece for the blow nozzles of this invention;

Figure 2:
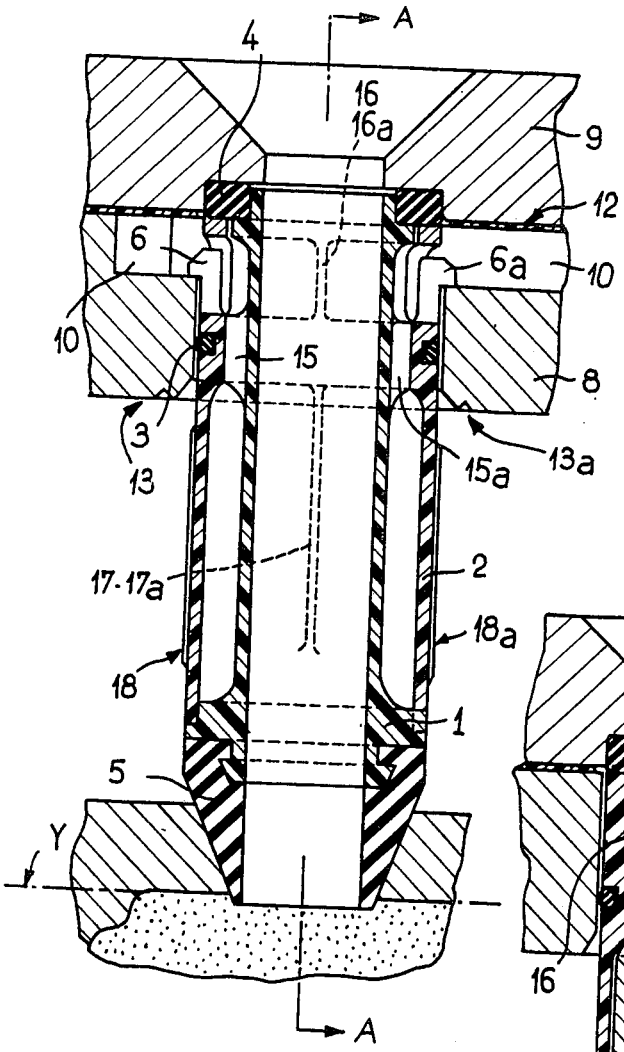
FIG. 2 is an axial longitudinal section showing a typical nozzle according to this invention with its nose-piece engaging the core plane Y.
Figure 3:
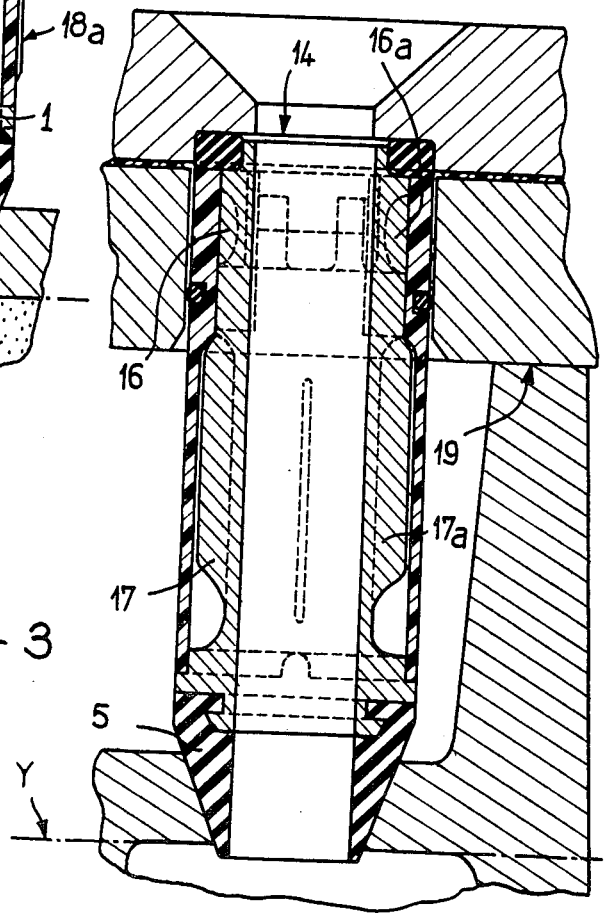
FIG. 3 is an axial longitudinal section taken along the line A—A of FIG. 2.

The nozzle according to the present invention for blowing foundry cores comprises five component elements. The nozzle body proper consists of an inner sleeve 1 cooperating concentrically with an external sleeve 2 on which a toroidal or O-ring seal 3 is fitted for sealing the joint with respect to the lower plate 8 of the filling tray on which the nozzle is fitted. At its upper end the inner sleeve 1 carries an elastomeric seal 4 bearing against an annular flange 40 in its assembled condition. The lower end of sleeve 1 is shaped for engagement with an end- or nose-piece of fluorinated elastomer having either a plain frustoconical shape 5 or a double frustoconical shape 5*a*. This nose-piece is adapted to engage a retaining groove 50 formed at the lower end of the inner sleeve 1 and to bear against an overlying annular flange or bead 70 thereof.

Formed on the flange 70 of sleeve 1 and on the lower edge of sleeve 2 are a stud 7*a* and a notch 7 of matching configurations, respectively, the stud 7*a* engaging the notch 7 in the assembled condition of these two sleeves 1 and 2.

For fixing the plastic nozzles in position it is only necessary to press them upwards when inserting the nozzles into their recesses, so that the two pairs of hooks 6, 6*a* formed integrally with the outer surface of the external sleeve 2 are firstly forced inwards and then allowed to expand for snap engagement with the edges of the cooling circuit groove 10 formed in the lower plate 8 of the filling tray, while compressing the seal 4 in a corresponding recess formed in the upper plate 9. A pair of visual reference marks 18, 18*a* spaced 180° apart and consisting of longitudinal ribs projecting from the outer surface of the external sleeve 2 enable the operator to properly position the nozzles, the filling tray comprising to this end two corresponding reference marks 13 and 13*a* cut in the bottom surface of the lower plate 8 and disposed likewise 180° apart, to indicate, when the tray is in its assembled condition, the position of the cooling circuit provided between the two plates 8 and 9.

Thus, when the nozzles are properly positioned, the upper portion of sleeve 1 provides, in relation to the cavities 14 of plate 9, a certain vertical clearance receiving the bearing seals 4 to afford a certain flexibility in the vertical or axial positioning of the various nozzles in relation to the tapered apertures provided in the top plate of the hot box, with due consideration, however, for the fact that the vertical thrust exerted by the bed of the machine which causes the hot box to be pressed against the filling tray, is controlled by the engagement between the upper surface 19 of the side walls of the hot box and the tray, thus limiting the permissible penetration of the nozzles into the hot box proper.

Preferably and for obvious standardization purposes, all the nozzles have the same axial dimension.

From this point of view, it is clear that the filling trays should be designed and constructed as a function of the nozzle dimensions and also of the upper surface of the core where the nozzles are operative. Under these conditions, two cases may arise:

1. All the nozzle outlets are disposed on a common plane of the core, and

2. One or a plurality of nozzle outlets are disposed on different planes of said core.

Figure 4:
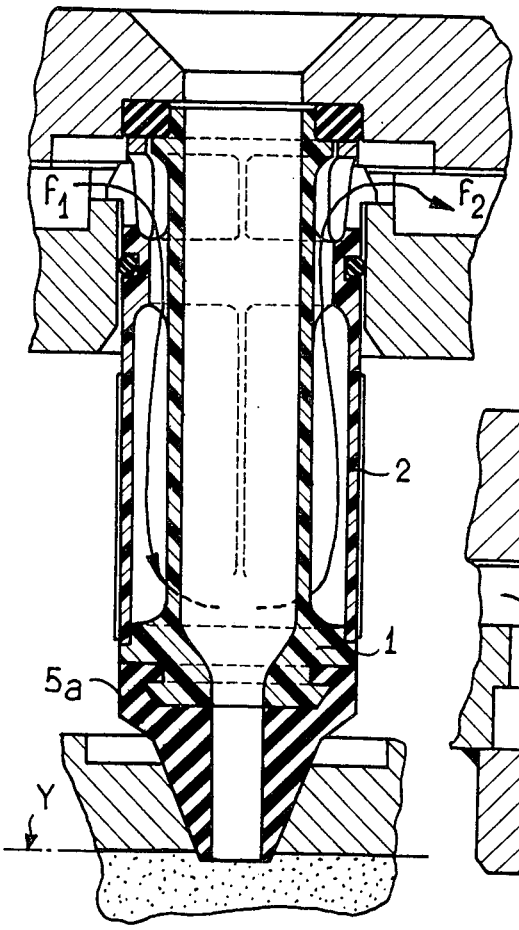
FIG. 4 is a view similar to FIG. 2 but showing a modified form of embodiment of the blow nozzle of this invention, and also leading to a plane Y of a core.

In case (1), the plate arrangement illustrated in FIG. 2 is combined with the nozzle diameters of nose-pieces 5, or alternatively the plate arrangement of FIG. 4 is combined with the nozzle diameters of nose-pieces 5*a*.

Figure 5:
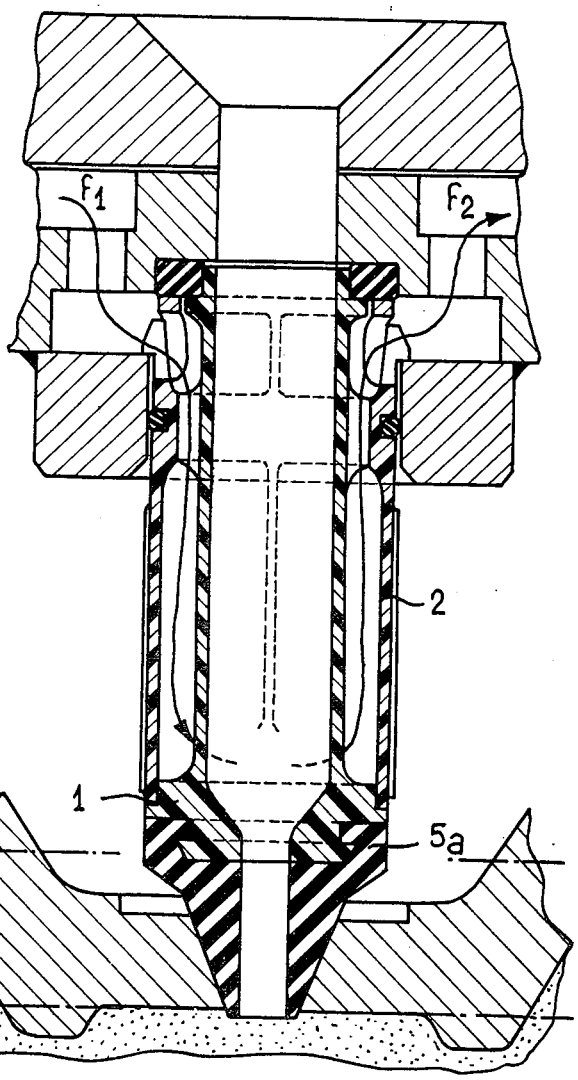
FIG. 5 is an axial longitudinal section showing the fitting of a nozzle in a filling tray, the nozzle nose-piece engaging the core on a plane Z lower than plane Y.

In case (2), the plate illustrated in FIG. 5 is suitable for all nozzle diameters, the nozzles being located in a plane disposed at a lower level than an upper plane corresponding to the first case (1), or alternatively the plate illustrated in FIG. 6 is used for all nozzle diameters disposed on planes above the general plane of the core.

All the nose-pieces 5, 5*a* consisting preferably of fluorinated elastomer have the same means for snap-fitting them to the inner sleeve 1, notwithstanding the difference in diameter of the sand passage. However, the external configuration may vary as a function of the desired diameters.

In the case of diameters using a nose-piece 5, the external configuration is that illustrated in FIG. 7.

In the case of diameters using a nose-piece 5*a*, the external configuration is that illustrated in FIG. 8.

It is strongly recommended not to use nose-pieces having an inner diameter other than the bore-diameter of the corresponding inner sleeve 1, to prevent the nose-piece from being stripped off the sleeve 1 during the filling operation in case the nose-piece inner diameter were smaller than that of said sleeve.

The vertex angle of the frustoconical portions of the fluorinated elastomer nose-pieces 5 or 5*a* which engage the corresponding recesses of the upper portions of the hot boxes is advantageously 45°. However, an angle of 50° is also acceptable. This angle value is advantageous in that it will not create a sharp angle when opening into the tool means, since this sharp angle would most likely be rounded off by the sand; however, other angular values may be used according the circumstances.

The rigid portion of the nozzle lies in the region where the O-ring 3 is fitted on the outer sleeve 2 and substantially level with the self-centering reinforcing means formed on the inner sleeve 1 comprising the passages 15 and 15*a* for the ingress and egress of the cooling fluid.

To provide a cooling circuit under pressure above and below the reinforced section of sleeve 1, ribs 16, 16*a* on the one hand and 17,17*a* are formed at 180° with respect to the fluid inlet, to force the fluid, for example water, to flow downwards along the sleeve 1 via passage 15 to the end of ribs 17 and 17*a*, and then upwards on the other side of said ribs 17, 17*a* and finally outwards via passage 15*a* before being discharged into the conduit or duct 10.

The improved filling tray according to this invention is such that a certain degree of precision in its manufacture is required only for the bottom plate 8. The mutual alignment or distance between centers with respect to the other plate 9 acting as a cover or closure to the cooling circuit and also as a passage means for the sand requires only a tolerance of the order of 1 millimeter.

The distance between centers obtained in the nozzle supporting plate 8 are those characterizing the hot box before it is heated, so that the makers of the tool means according to this invention can easily compare and control the tolerances beween the filling tray and the hot box.

In order to obtain a satisfactory fluid tightness between the plates 8 and 9, a flat gasket 12 cut from a standard sheet gasket material is provided. Holes having a diameter greater than that of the recesses formed in plate 9 for engaging, or acting as a seat to, the ring seal 4, are formed in plate 9. These holes do not require a fine degree of precision and may for instance be even 2mm larger than the diameter of said recesses.

The provision of this ring seal 4 makes it possible to dispense with the various milling operations which had hitherto been necessary in plate 8 or 9 for receiving a cylindrical-sectioned gasket of adequate length according to the size of the filling tray.

In this tray the cross-sectional area of the cooling passages, ducts or conduits, as well as the cross-sectional area of the bores of said nozzle admit relatively wide tolerances.

Figure 9:
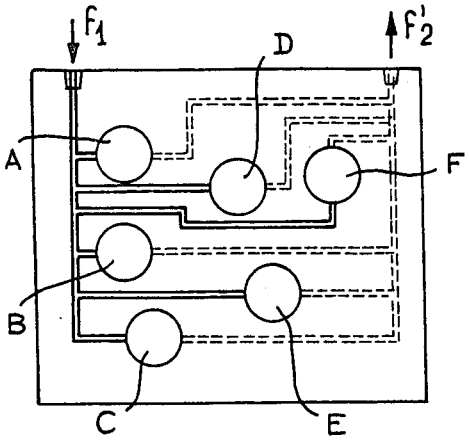
FIG. 9 is a diagrammatic general view showing a plurality of nozzles according to the present invention mounted on a filling tray incorporating circuit means for cooling the nozzles.

In certain known filling trays the so-called double cooling circuit is used which comprises parallel-connected ducts (FIG. 9) for the nozzles A, B, C, D, E and F, i.e. a duct for supplying water to all the nozzles as shown by the arrow $f_1$; this water then flows through the nozzles and is eventually rejected into another circuit and thus discharged from the filling tray, as shown by the arrow $f_2$.

Figure 11:
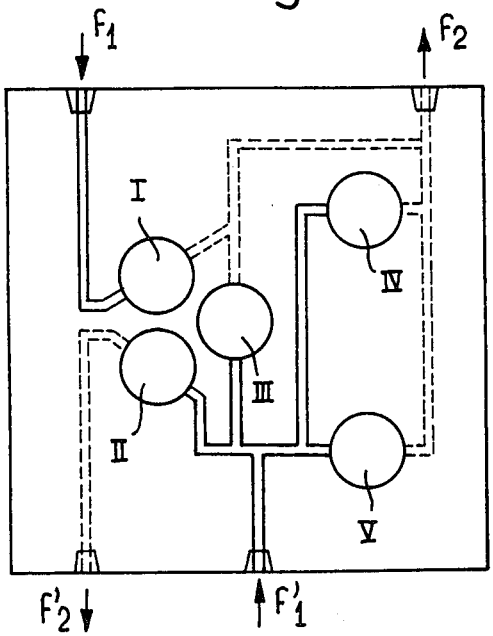
FIG. 11 is another modified disposition of the nozzles of this invention mounted on a filling tray equipped with a cooling system.

Furthermore, it will be seen that according to this principle a preferential flow circuit may tend to build up so that certain nozzles may not be supplied as desired. Moreover, this type of double cooling circuit requires more elaborate and longer milling operations, so that it is more expensive, and besides, since the distance between centers of adjacent nozzles is extremely reduced, the next circuits (FIGS. 9 and 11 — nozzles A, B, C, D, E, F and I, II, III, IV and V, respectively) must be multiplied.

Figure 10:
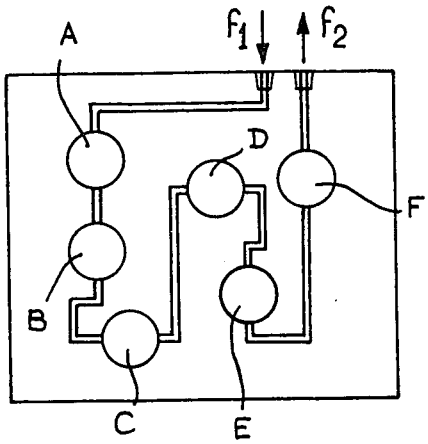
FIG. 10 is a modified disposition of the diagram of FIG. 9.
Figure 12:
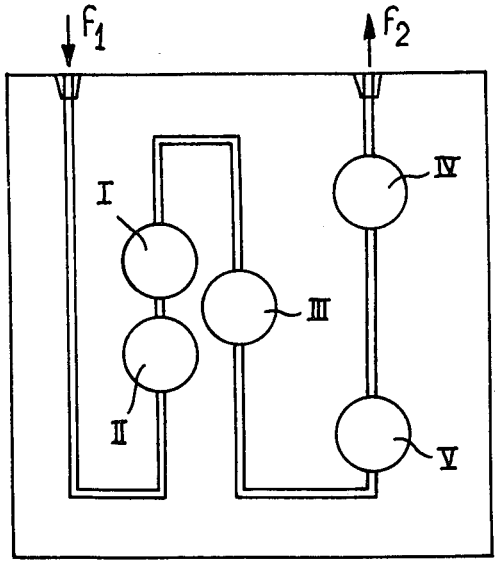
FIG. 12 is a modified form of embodiment of the arrangement shown in FIG. 11.

With the circuit formed in this simplified tray structure the nozzles A to F (FIG. 10) are series-connected. There is no preferential circuit, since the water must compulsorily flow through each nozzle; each nozzle will thus receive the same water output before this water continues its cooling function along the various meanders of the tray and before being eventually discharged to the outside, even in the case of relatively close-spaced nozzles (as at I, II, III, IV and V, FIG. 12).

Another simplification in the construction of the filling tray is due to the use of plastic nozzles which, as already mentioned in the foregoing, are self-fitting. One advantage resulting from this arrangement is that all machining steps for fastening members and other parts intended for rigidly securing the nozzles on the filling tray are eliminated.

The nose-pieces 5 and 5*a* advantageously consist of a fluorinated elastomer, for example of the type known under the trade mark "VITON" and manufactured by the Dupont de Nemours Company.

Of course, this invention should not be construed as being strictly limited by the specific forms of embodiment of the nozzles and filling trays described and illustrated herein, for various modifications and changes will readily occur to those conversant with the art without departing from the basic principles of the invention as set forth in the appended claims.

What is claimed as new is:

1. A foundry core blow nozzle to be fitted on a filling tray having a cooling circuit, the filling tray being of the type used in a so-called hot-box process, said nozzle comprising:

a. a pair of plastic tubular sleeves including a male sleeve and a female sleeve concentrically assembled and providing an annular passageway therebetween, constituting a cooling jacket, for circulating cooling fluid, said male sleeve having a flange integrally formed thereon and carrying at a lower end a plastic nose piece to withstand heavy abrasive and thermal conditions;

b. a stud formed on said flange, said female sleeve having a notch on a bottom peripheral edge thereof, and said stud being engaged in said notch;

c. two pairs of fastening hooks integrallly formed on said female sleeve near an upper end thereof for snap action locking engagement into the cooling circuit of the filling tray; and d. ribs formed integrally on one of said sleeves and extending into said passageway to provide a labyrinth for the circulation of the cooling fluid.

2. A foundry core blow nozzle assembly, comprising:

a. a filling tray, of the type used in a so-called hot-box process, including a pair of superposed plates assembled to each other, and a sheet-type gasket providing fluid tightness between said plates, one of said plates including a cooling circuit in the form of a groove having a length varying as a function of a path to be used for ensuring a maximum cooling efficiency; and b. a pair of plastic tubular sleeves including a male sleeve and a female sleeve concentrically assembled and providing an annular passageway therebetween, constituting a cooling jacket, for circulating cooling fluid, said male sleeve having a flange integrally formed thereon and a stud formed on said flange, said male sleeve carrying at a lower end a plastic nose piece to withstand heavy abrasive and thermal conditions, said female sleeve including a notch in which said stud is engaged and two fastening hooks integrally formed on said female sleeve near an upper end thereof for snap action locking engagement into said cooling circuit of said one plate, and ribs formed integrally on one of said sleeves and extending into said passageway to provide a labyrinth for the circulation of the cooling fluid.

3. A foundry core blow nozzle to be fitted on a filling tray having a top plate and a bottom plate in superposed relationship, the bottom plate having a cooling circuit and a plurality of bores provided with sealing means, said nozzle comprising:

a pair of plastic tubular sleeves including a male sleeve and a female sleeve concentrically assembled and providing an annular passageway therebetween constituting a cooling jacket for circulating cooling fluid, said male sleeve carrying at its lower end a plastic nose-piece to withstand heavy abrasive and thermal conditions, and two pairs of fastening hooks formed integrally on said female sleeve near an upper end thereof for snap action locking engagement into the cooling circuit of the bottom plate, said hooks being such that the snap action engagement is attended by the compression of a seal means in a bore of the bottom plate.

* * * * *